US009127899B2

(12) United States Patent
Shipman

(10) Patent No.: US 9,127,899 B2
(45) Date of Patent: Sep. 8, 2015

(54) MULTIPURPOSE TOOL FOR MAINTAINING A FIREARM

(71) Applicant: The Otis Patent Trust, Lyons Falls, NY (US)

(72) Inventor: Kel Shipman, Canandaigua, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 67 days.

(21) Appl. No.: 13/741,970

(22) Filed: Jan. 15, 2013

(65) Prior Publication Data

US 2013/0192118 A1 Aug. 1, 2013

Related U.S. Application Data

(60) Provisional application No. 61/587,426, filed on Jan. 17, 2012.

(51) Int. Cl.

| | |
|---|---|
| ***F41A 29/02*** | (2006.01) |
| ***F41A 29/00*** | (2006.01) |
| ***F41C 27/00*** | (2006.01) |
| ***F41G 1/54*** | (2006.01) |

(52) U.S. Cl.
CPC ..... *F41A 29/02* (2013.01); *F41C 27/00* (2013.01); *F41G 1/545* (2013.01)

(58) Field of Classification Search
CPC ..... F41A 29/00; F41A 29/02; F41A 20/04
USPC ..... 42/85, 90, 95, 106, 108
See application file for complete search history.

(56) References Cited

U.S. PATENT DOCUMENTS

| | | | | |
|---|---|---|---|---|
| 2,897,525 | A | 8/1959 | Goodwin et al. | |
| 4,324,018 | A * | 4/1982 | Olsson | 15/236.03 |
| 4,862,544 | A * | 9/1989 | Wallace | 7/118 |
| 5,417,003 | A * | 5/1995 | Claveau | 42/90 |
| 5,557,871 | A | 9/1996 | LaLonde | |
| 5,588,242 | A | 12/1996 | Hughes | |
| 6,230,430 | B1 * | 5/2001 | Gosselin | 42/90 |
| D564,316 | S * | 3/2008 | Elkaim | D8/17 |
| 7,637,049 | B1 * | 12/2009 | Samson et al. | 42/108 |
| 7,644,529 | B2 * | 1/2010 | Hopper et al. | 42/90 |

(Continued)

OTHER PUBLICATIONS

GloablSecurity.org, M249 Machine Gun, Feb. 20, 2005, http://www.globalsecurity.org/military/library/policy/army/fm/3-22-68/c01.htm.*

(Continued)

*Primary Examiner* — Bret Hayes
*Assistant Examiner* — Derrick Morgan
(74) *Attorney, Agent, or Firm* — Harris Beach PLLC

(57) ABSTRACT

A multipurpose tool for maintaining a rifle, comprising a planar body including a wider portion and a narrower portion of a first edge and a curved transition portion therebetween, wherein the narrower portion terminates in a hook-shaped element having a flat portion whose dimension is less that the outer diameter of a bolt piston of the rifle; an arm pivotably attached to the planar body and terminating in first and second prongs defining a notch sized to fit over a front sight adjusting screw of an AR or AK type rifle; and a pin pivotably joining the planar body and the arm. The body may further comprise a notch formed in a second edge opposite the first edge for assisting in disengaging a gas tube release lever of the rifle. The body may further comprise a scraper sized to fit within the gas block of the rifle.

4 Claims, 4 Drawing Sheets

(56) References Cited

U.S. PATENT DOCUMENTS

| | | | | |
|---|---|---|---|---|
| 1,020,938 | A1 | 9/2011 | Iosso et al. | |
| D666,883 | S * | 9/2012 | Howard et al. | D8/19 |
| 8,327,571 | B2 * | 12/2012 | Jaquish et al. | 42/95 |
| 8,479,404 | B1 * | 7/2013 | Samson et al. | 33/506 |
| 2009/0199345 | A1 * | 8/2009 | Morgan | 7/118 |
| 2010/0186769 | A1 * | 7/2010 | Jaquish et al. | 134/6 |
| 2010/0325933 | A1 * | 12/2010 | Huang | 42/90 |
| 2011/0047852 | A1 | 3/2011 | Loftin | |
| 2011/0138540 | A1 * | 6/2011 | Kinskey et al. | 7/105 |
| 2011/0197489 | A1 * | 8/2011 | Barsoumian | 42/90 |
| 2011/0283588 | A1 * | 11/2011 | Samson et al. | 42/108 |
| 2012/0186127 | A1 * | 7/2012 | Shipman et al. | 42/95 |
| 2013/0255722 | A1 * | 10/2013 | Davis | 134/8 |

OTHER PUBLICATIONS

WorthPoint, M249 Saw Combination/ Multi TOol, Jun. 17, 2008, http://www.worthpoint.com/worthopedia/m249-saw-combination-multi-tool-usgi-issue#rpctoken=248889000&forcesecure=1.* http://www.gngtools.com/gngboltcleanerandpolisher-1.aspx dated Apr. 19, 2012 (2 pgs).

http://www.m-guns.com/tool_new.php?product=moacks dated Apr. 19, 2012 (2 pgs).

http://www.brownells.com/.aspx/pid=31833/Product/AR-15-M16-BOLT-RADIUS-SCRAPER dated Apr. 19, 2012 (1 pg).

http://www.botachtactical.com/kzcrtcareto.html dated Apr. 19, 2012 (2 pgs).

http://slickguns.com/product/kz-m4crst-carbon-removal-super-tool-1438-after-coupon-free-shipping dated Apr. 19, 2012 (2 pgs).

* cited by examiner

MULTIPURPOSE TOOL FOR MAINTAINING A FIREARM

RELATIONSHIP TO OTHER APPLICATIONS AND PATENTS

This application draws priority from a pending U.S. Provisional Patent Application, Ser. No. 61/587,426, filed Jan. 17, 2012.

FIELD OF THE INVENTION

This disclosure relates generally to firearm cleaning tools and, more specifically, to a multipurpose tool for use in cleaning and maintaining a firearm bolt piston and bolt carrier.

BACKGROUND OF THE INVENTION

It is well known in the weapon arts that the firing chambers of small arms, and especially rapid-repeating arms discharging a large volume of ammunition, can suffer from a build-up of combustion byproducts from gun powder, accelerants, and sealants contained in the ammunition, which must be removed periodically to restore proper firing action. This is especially troublesome for AK-47 type rifles. Outside the U.S., many ammunition suppliers use a lacquer-based sealant between the projectile (bullet) and the casing of cartridge ammunition. When a round is fired, the lacquer is partially burned, and the combustion products form a particularly stubborn build-up of residue inside the firing chamber and on the firing mechanism that can interfere with operation of the rifle. Specially formed tools and brushes, along with appropriate solvents, can be very helpful in removing these deposits and restoring such a rifle to proper working order.

A problem with prior art cleaning tools is that a substantial plurality of different tools may be required to clean a plurality of different surfaces in the firing mechanism of a rifle. Having a multiplicity of special-purpose tools adds to the field weight of a tool kit; and further, individual of such tools can be prone to being lost or misplaced.

What is needed in the art is a multipurpose tool comprising a plurality of tool functions that is useful for cleaning and/or adjusting a plurality of rifle components.

It is a principal object of the present invention to improve and facilitate cleaning of firing chambers and related components of small arms, and especially of AR and AK type rifles.

SUMMARY OF THE INVENTION

Briefly described, a tool in accordance with the present invention is formed to perform at least five important functions in the cleaning and maintenance of an AR or AK type weapon.

A pivoting arm terminates in a notch useful as a wrench in adjusting front sight elevation of an AR or AK type rifle.

A body includes a curved transition portion and terminates in a hook-shaped element having a flat portion whose dimension is slightly less that the outer diameter of the bolt piston of a rifle. The transition portion approximates the shape of a transition portion in the bolt. When the bolt piston is mounted to tool, rotation of the bolt against the edges of the tool serves to scrape unwanted deposits from the outer diameter and transition portion of the bolt.

A portion of the body is provided with opposed first and second scrapers. The dimension between the scrapers is such that a tool end just fits into a gas block of an AK series rifle. Rotation of the tool serves to scrape unwanted deposits from the interior of the gas block.

A portion of the body is provided with a notch that is useful in disengaging the gas tube release lever for removal of a gas tube from an AK series rifle.

A hole in the body is sized to pass the shaft but not the head of a cleaning rod. When the tool is slipped onto the rod prior to its being passed down the rifle barrel and attached to a cleaning patch, the tool provides a convenient and powerful T-handle for pulling the rod and cleaning patch through the rifle barrel.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
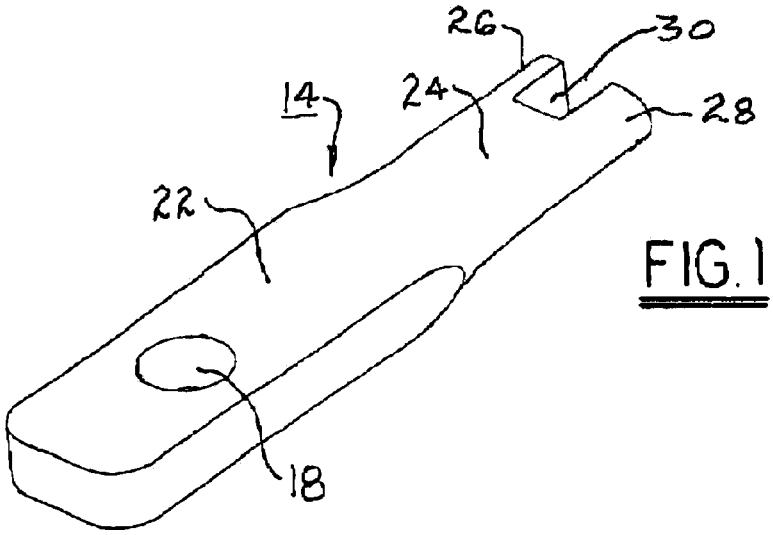
FIG. 1 is an isometric drawing of a pivoting arm for a tool in accordance with the present invention.
Figure 2:
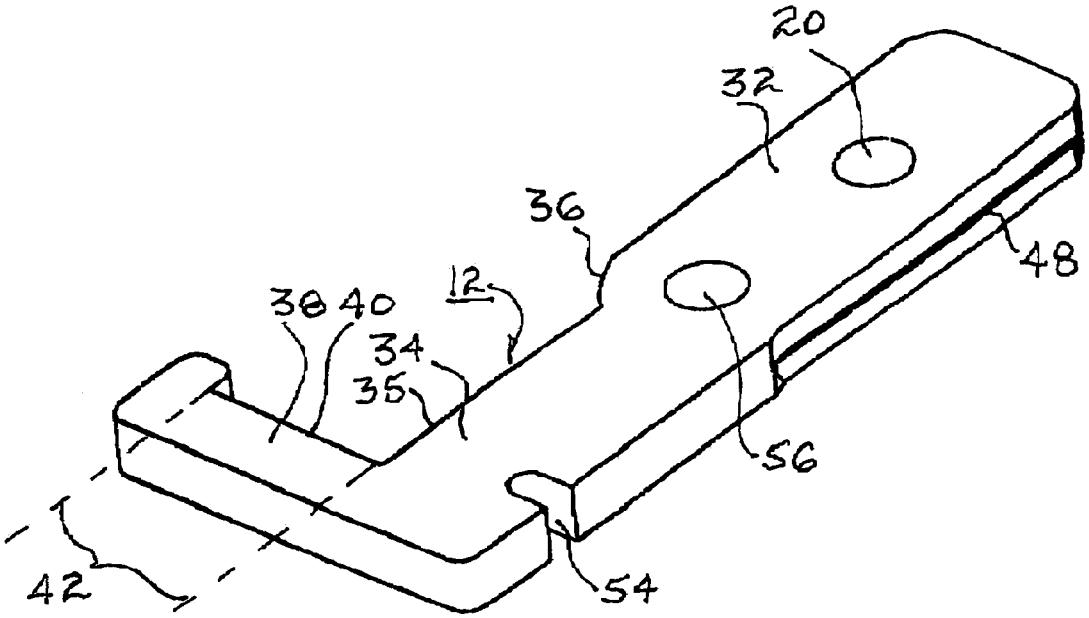
FIG. 2 is an isometric drawing of a body for a tool in accordance with the present invention.

Referring to FIGS. 1 through 6, a multifunctional tool 10 in accordance with the present invention for cleaning components of a rifle 500 comprises a generally planar body 12 formed of a steel alloy, a generally planar pivoting arm 14 formed preferably of a steel alloy, and a pivot pin 16 formed preferably of brass, pivotably connecting body 12 and arm 14 via respective holes 18, 20.

Exemplary tool 10 is formed to perform a plurality of, and preferably at least five, important functions in the cleaning and maintenance of an AR or AK type weapon:

1. Pivoting arm 14 includes a first width portion 22 and a narrower width portion 24 terminating in first and second prongs 26, 28 preferably rounded on their outer edges and defining a notch 30. Prongs 26, 28 and notch 30 are sized to fit over a front sight adjusting screw 504 such that pivoting arm 30 is useful as a wrench in adjusting front sight elevation of an AR or AK type rifle.

2. Body 12 includes a wider portion 32 and a narrower portion 34 having an edge 35 and a curved transition portion 36 therebetween. Narrower portion 34 terminates in a hook-shaped element 38 having a flat portion 40 whose dimension 42 is less that the outer diameter 43 of bolt piston 44. Transition portion 36 approximates the shape of transition portion 36' in bolt 44.

Figure 4:
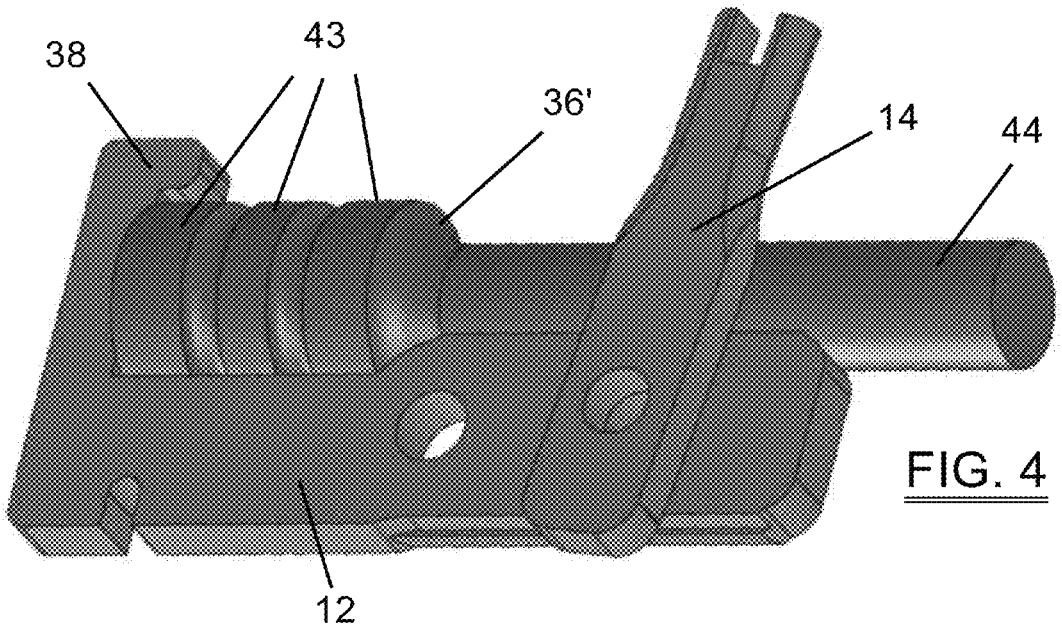
FIG. 4 is an isometric view of the tool shown in FIG. 3, illustrating the tool function of scraping the outer diameter and transition portion of a bolt piston at the end of a rifle bolt.
Figure 5:
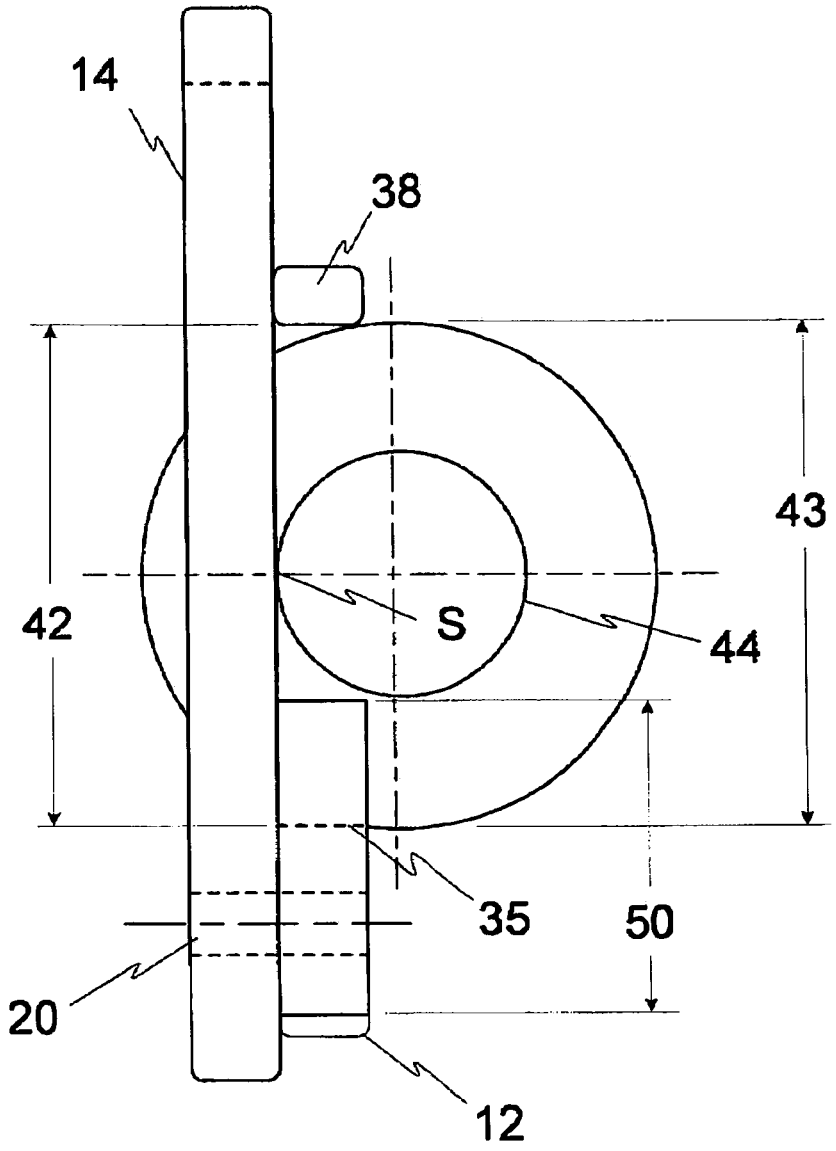
FIG. 5 is a plan end view of the scraping tool and rifle bolt piston of FIG. 4.
Figure 6:
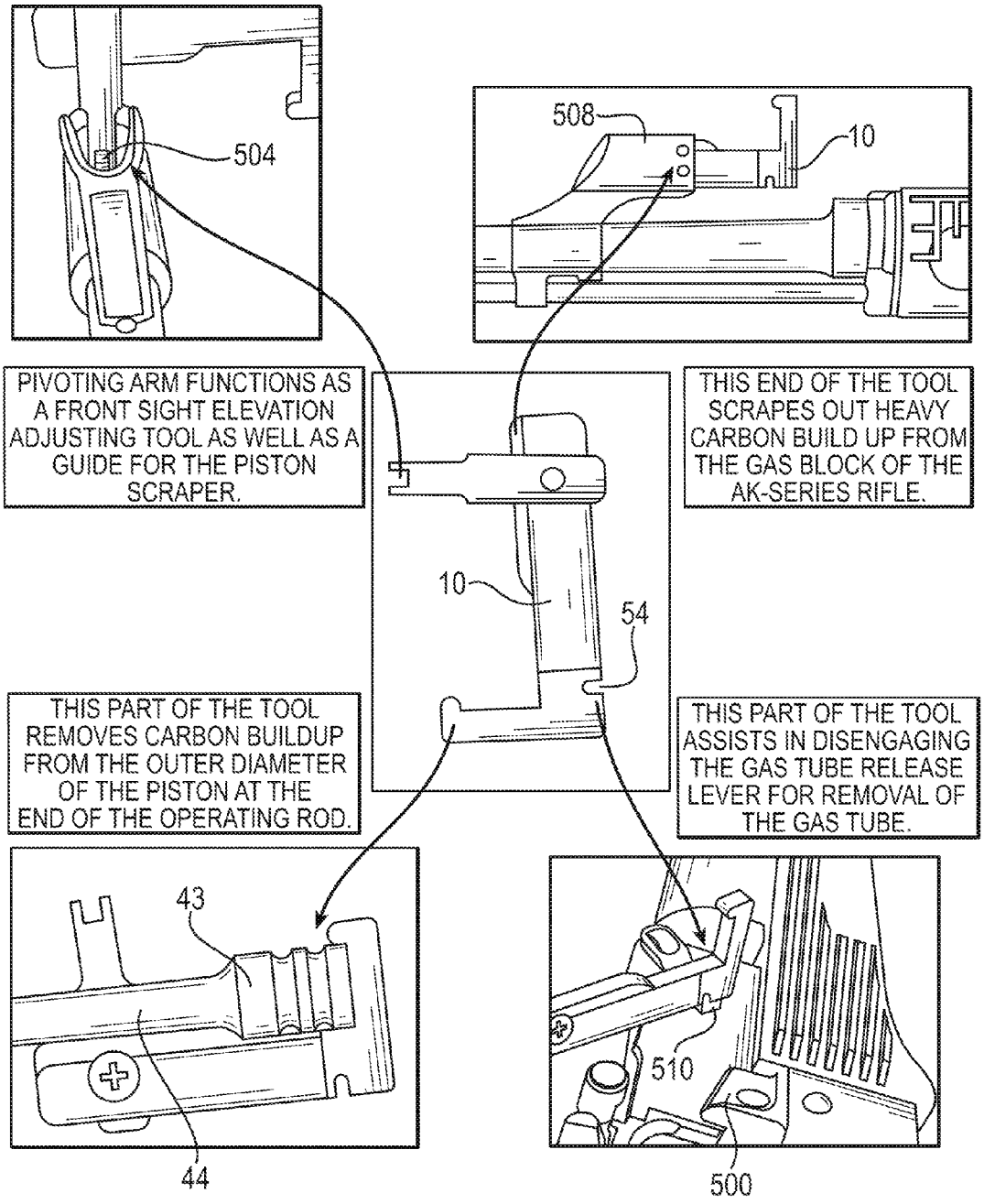
FIG. 6 depicts several uses and functions of a multifunctional tool in accordance with one embodiment of the invention.

As shown in FIG. 4, FIG. 5, and FIG. 6, when bolt piston 44 (also commonly referred to as a gas piston) is mounted to tool 10, pivoting arm 14 is rotated to provide a tool rest surface (S) for the smaller-diameter shank of bolt piston 44. With the shank resting on surface (S), the larger-diameter gas ring portion 43 is captured and loosely secured by hook-shaped element 38. Since the spacing dimension 42 of tool 10 is less than the outer diameter 43 of the gas ring portion of bolt piston 44, scraping surface 35 engages the outer diameter 43 in an off-center alignment from the axial centerline of bolt piston 44, thereby providing improved scraping contact relative to previous scrapers that merely match the gas ring diameter. In one embodiment, the hook-shaped element 38 can also have a scraping edge to engage an axial portion of the gas ring diameter 43.

Rotation of the bolt piston 44 against the edge 35 of tool 10 allows a user to effectively scrape outer diameter 43 of bolt piston 44 free of carbon and other discharge residue in just a few, quick rotations with a bolt tool 10 that is rugged yet very small and lightweight and well-suited to field use.

Figure 3:
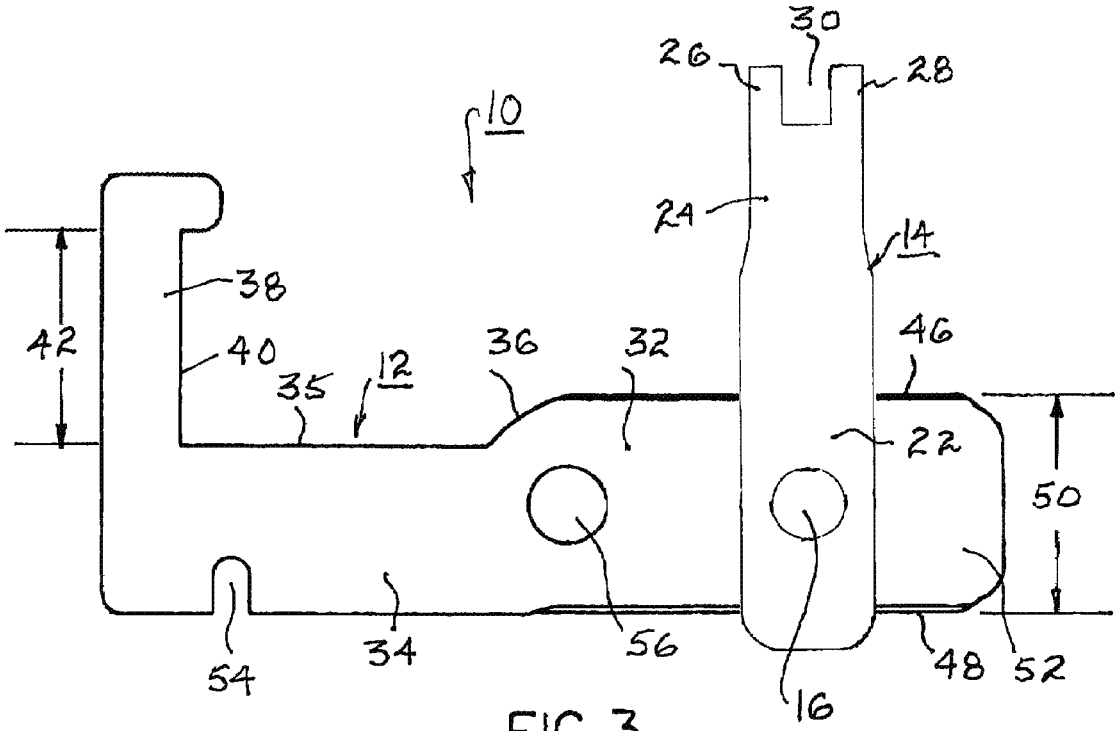
FIG. 3 is a plan view of an assembled multifunction tool in accordance with the present invention.

In one embodiment, best illustrated in FIG. 3 and FIG. 5, the transition portion 36 of tool 10 can be sized and formed to receive the curved transition portion of the bolt face 36' in an off-center alignment from the axial centerline of bolt piston 44. In this manner, more than one axial surface of the bolt piston 44 can be scraped at the same time. In one example, surfaces 35 and 36 can be adapted as scraping surfaces for the gas ring diameter 43 and the piston transition portion 36', respectively, of bolt piston 44. The scraping surfaces 35, 36, are in off-center alignment relative to the axial centerline of bolt piston 44.

As best appreciated with reference to FIGS. 3-5, the scraping surface 36 aligns with bolt piston 44 at compound angles relative to a radial plane taken through the centerline of the bolt. Stated another way, generating the off-center scraping surface 36 is not a simple matter of creating a scraper profile through the centerline of the bolt and offsetting the profile. Rather, in order for the scraping surface 36 to conform to the bolt transition surface 36' at all points, the scraping profile can be advantageously created with computer-aided graphics programs. The resulting scraper profile (e.g., scraping surface 36) is thus suited for a bolt of a particular model firearm, and would not be adaptable to another model firearm. The illustrated tool 10 is suited for the bolt of an AK-model firearm, but may be adapted for use with an M16, AR15, or bolt for a firearm such as one that uses a 5.56 cartridge, a 7.62 cartridge, or other type of round.

In a further embodiment (not illustrated), surface 46 of tool 10 can be further adapted to provide a scraping surface for the smaller-diameter shank portion of bolt piston 44. In one example, an off-center alignment of scraping surface 46 can be realized by appropriately dimensioning surface 46 relative to the tool rest surface (S) and the hook-shaped element 38. In this manner, when the smaller-diameter shank of bolt piston 44 is at rest on surface (S) and the larger gas ring diameter 43 is captured by hook-shaped element 38, surface 46 can contact the shank portion of bolt piston 44 in off-center alignment.

Tool 10 provides a number of additional advantages. Tool 10 is thin enough to allow a degree of flexibility to aid in truly conforming to the surfaces of the gas ring surface 43 and bolt face 36' of bolt piston 44, instead of being thick enough to be completely rigid and unable to flex to conform to the complex surfaces of bolt piston 44. This flexible conformity facilitates the edges of the scraping surfaces 35, 36 of tool 10 forming a true scraping edge against the surfaces of bolt piston 44. The sizing and shaping of tool 10 that result in the off-center engagement with bolt piston 44 also ensure that it is the edges of the surfaces 35, 36, not the full-on surfaces, that engage the surfaces of bolt piston 44, which also facilitates a true scraping engagement. The off-center conforming shape also means tool 10 has a smaller size than if it were sized to conform over the center of the bolt face 43 of the bolt piston 44. This smaller size, along with the thinness of tool 10, also makes for a lighter weight, which in turn makes tool 10 more suitable for field use. This smaller size also enables tool 10 to fit inside the stock of a rifle to which bolt piston 44 belongs, such as an M16, while larger bolt scraper tools would not be able to.

3. Wider portion 32 of body 12 may be provided with at least one linear scraper 46, and preferably also a second opposing linear scraper 48. The dimension 50 between the edges of scrapers 46, 48 is such that tool end 52 (with pivoting arm folded down) fits snugly into a gas block 508 of an AK-series rifle. Rotation of tool 10 serves to scrape unwanted deposits from the interior of the gas block.

4. Narrower portion 34 of body 12 is provided with a notch 54 that is useful in disengaging the gas tube release lever 510 for removal of a gas tube from an AK series rifle.

5. Hole 56 in body 12 is sized to pass the shaft but not the head of a cleaning rod or flexible cable (not shown). When tool 10 is slipped onto the rod prior to its being passed down the rifle barrel and attached to a cleaning patch, tool 10 provides a convenient and powerful T-handle for pulling the rod and cleaning patch through the rifle barrel.

A sample of devices and methods that are described herein is as follows:

A multipurpose tool for maintaining a firearm, comprising:

a planar body having a first end and an opposing second end, the first end of the body comprising a hook-shaped element defining an opening adapted to receive a gas ring portion of a firearm bolt, the opening bounded by an upper tang, a flat portion approximately transverse to the tang, and a scraping surface approximately parallel to the tang and transverse to the flat portion;

wherein the distance between the upper tang and the scraping surface of the opening is less than an outer diameter the gas ring portion of the firearm bolt, such that placement of the firearm bolt in the multipurpose tool positions the scraping surface at an off-center alignment relative to the gas ring portion.

The multipurpose tool of paragraph [0034], further comprising a pivoting arm rotateably coupled to the planar body, the pivoting arm providing a tool rest surface for a smaller-diameter shank of the firearm bolt.

The multipurpose tool of paragraph [0035], wherein the pivoting arm terminates in first and second prongs defining a notch, the notch sized to fit over a front sight adjusting screw of the firearm.

The multipurpose tool of paragraph [0036], wherein the firearm is an AK-type rifle.

The multipurpose tool of paragraph [0035], further comprising a pin pivotably joining the planar body and the pivoting arm.

The multipurpose tool of paragraph [0034], the planar body further comprising a transition surface extending from the scraping surface, the transition surface approximating a transition surface on the bolt from the gas ring portion to the smaller-diameter shank portion.

The multipurpose tool of paragraph [0039], wherein the transition surface is curved.

The multipurpose tool of paragraph [0039], wherein the transition surface is sloped.

The multipurpose tool of paragraph [0039], wherein the transition surface is linear.

The multipurpose tool of paragraph [0039], wherein the planar body further comprises a first gas block scraping surface extending from the transition surface.

The multipurpose tool of paragraph [0043], wherein the planar body further comprises a second gas block scraping surface opposing the first gas block scraping surface, the second gas block scraping surface dimensioned a distance from the first gas block scraping surface approximately equal to a gas block diameter of the firearm.

The multipurpose tool of paragraph [0034], the planar body further comprising a notch formed in a second edge opposite the scraping surface, the notch adapted to assist in disengaging a gas tube release lever of the firearm.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A multipurpose tool for maintaining components of an AK style rifle including an AK style rifle gas piston having a longitudinal shank, a transition surface, and gas piston rings, and an AK style rifle gas block having an internal diameter which receives said gas piston, the tool comprising:

a planar L shaped body comprising a first leg and a second leg, said first leg comprising:

a first portion of said first leg of said planar L shaped body to scrape the AK style rifle gas block, said first portion of said first leg having a first scraping side and a second scraping side on opposite sides of said first leg, wherein a distance (50) between said first scraping side and a second scraping side is such that when said first portion of said first leg of said planar L shaped body is inserted into the gas block and rotated, said first scraping side and a second scraping side scrapes an interior diameter of the gas block;

a second portion of said first leg having a third scraping edge to scrape the AK style rifle gas rings of the gas piston;

said second leg of said planar L shaped body having a hook end extending from said second leg and defining a distance (42) between an inside edge of said hook end and said third scraping edge which is less than the diameter of the gas ring, said inside edge of said hook end substantially parallel to and opposite said third scraping edge; and a pivot arm pivotally attached to said L shaped body, wherein when said pivot arm is extended transverse to a longitudinal axis of said first leg of said planar L shaped body, said pivot arm supports the longitudinal shank wherein the gas rings of the gas piston rest between said third scraping edge and an edge of said hook without passing through, so that said third scraping edge of said second portion of said first leg scrapes the gas ring surfaces of the gas piston where the longitudinal axis of the gas piston is offset but parallel to a plane defined by said L shaped body as the gas piston is rotated about the longitudinal axis of the gas piston.

2. The multipurpose tool of claim 1, further comprising between said third scraping edge and said first scraping surface a curved transition surface conformed to scrap the transition surface of the gas piston.

3. The multipurpose tool of claim 1, wherein said pivot arm terminates in a first prong and a second prong which define a notch, said notch being sized to fit over a front sight adjusting screw of said AK style rifle.

4. The multipurpose tool of claim 3, wherein said notch is adapted to assist in disengaging a gas tube release lever of the AK style rifle.

* * * * *